United States Patent [19]

Kragle

[11] Patent Number: 4,967,965

[45] Date of Patent: Nov. 6, 1990

[54] TWO-HEAD SHOWER ARM

[76] Inventor: George D. Kragle, 10006 Woodrow St., Vienna, Va. 22180

[21] Appl. No.: 371,098

[22] Filed: Jun. 26, 1989

[51] Int. Cl.[5] ..... B05B 1/18

[52] U.S. Cl. ..... 239/548

[58] Field of Search ..... 4/601, 596; 239/280–283, 200, 548, 587, 588, 561, 562, 565, 548

[56] References Cited

U.S. PATENT DOCUMENTS

| | | | |
|---|---|---|---|
| 2,336,402 | 12/1943 | Kaiser | 4/601 |
| 3,121,235 | 2/1967 | Gellmann | 4/601 X |
| 3,461,870 | 8/1969 | Van Linge | 239/565 X |
| 3,822,826 | 7/1974 | Wilson | 239/282 X |
| 3,971,074 | 7/1976 | Yxfeldt | 4/601 X |
| 4,539,720 | 9/1985 | Westerweller | 4/596 X |

*Primary Examiner*—Andres Kashnikow
*Assistant Examiner*—Kevin P. Weldon
*Attorney, Agent, or Firm*—Walter F. Wessendorf, Jr.

[57] ABSTRACT

A two-head shower arm has upstream and downstream pipe portion discharge ends, with the downstream pipe portion discharge end spraying shower water vertically above the upstream pipe portion discharge end. The downstream pipe portion discharge end covers the head, shoulders and back of the bather standing erect with shower water, while the upstream pipe portion discharge end covers the rest of the bather's body with shower water, to correct the problem of a single-head shower arm installed incorrectly too low vertically above the floor of a shower unit.

3 Claims, 1 Drawing Sheet

TWO-HEAD SHOWER ARM

BACKGROUND OF THE INVENTION

1. Technical Field

This invention relates to a rigid, two-head shower arm having upstream and downstream pipe portions, of integral, one-piece construction, for fixed, free-standing, cantilever-mounting relationship with a female-threaded water supply outlet fitting in a showerside wall, with the downstream pipe portion discharging shower water vertically above the upstream pipe portion, thereby spraying and covering a bather's head, shoulders and back more completely and equally with shower water.

2. Background

According to U.S. government statistics, the average male person is 5'-8" tall and the average female person is 5'-4" tall. The Association of Plumbing and Heating Contractors recommends that the female-threaded water supply fitting be installed 6' to 6'-8" above the floor of the shower unit. The Kitchen and Bath Contractors Association reports that 6 to 12 million of the female-threaded water supply outlet fittings in the U.S. were incorrectly installed 5' above the floor. In point of fact, a noted do-it-yourself manual suggests that the female-threaded water supply outlet fitting be installed 5' above the floor. The average incorrect installation is anticipated to be 5'-9" above the floor. With a conventional shower arm curving downwardly and projecting vertically downward at least 4", this means that the 5'-8" average male bather still has to duck his head at least 3" just for his head to physically clear and not strike the shower head itself. With a single-head shower arm installed 5' off the floor, a male bather of 5'-8" average height has to vertically contract his body 12" and, therefore, has no choice but to squat down to shampoo his hair, let alone to bathe his body. A female bather of 5'-4" average height would likewise encounter a similar problem.

To correct the problem requires removal of shower-side-wall tile, breaking through the shower-side-wall sheetrock to gain internal access to install a coupling and a 12"-20" nipple to raise and vertically extend the female-threaded water supply outlet fitting a like amount, rehanging the sheetrock, re-installing new ceramic tile and caulking the tuib-wall seam. There would be additional expenses: (1) if the shower-side wall is plaster and lathe; (2) if the entire bathroom had to be repainted to blend the damaged shower-side wall with the rest; (3) if tiles are damaged on the wall of the shower unit during the work; (4) if the work is in a confined space such as a closet; (5) if there is paneling or wall paper on the wall area; (6) if the ceramic tiles have to be installed over gypsum cement backer board: (7) if the tiles have to be installed over a concrete block wall; (8) if the ceramic tiles can not be matched and the entire shower unit area must be retiled. Consistent with prevailing contractors' prices to correct the problem, it could cost anywhere from $450 to $2,300 to correct the problem.

SUMMARY OF THE INVENTION

To contribute to the solution of and to correct this problem at a minimum of expense, all one needs to do is to simply remove the conventional single shower arm from the female-threaded water supply outlet fitting and replace same by either one of the embodiments shown in FIGS. 2 or 3.

BRIEF DESCRIPTION OF THE DRAWINGS

This object and other objects of the invention should be discerned and appreciated from the description of the preferred embodiments taken in conjunction with the drawing, wherein like reference numerals refer to similar parts throughout the drawing figures, in which.

DESCRIPTION OF THE PREFERRED EMBODIMENTS

Figure 1:
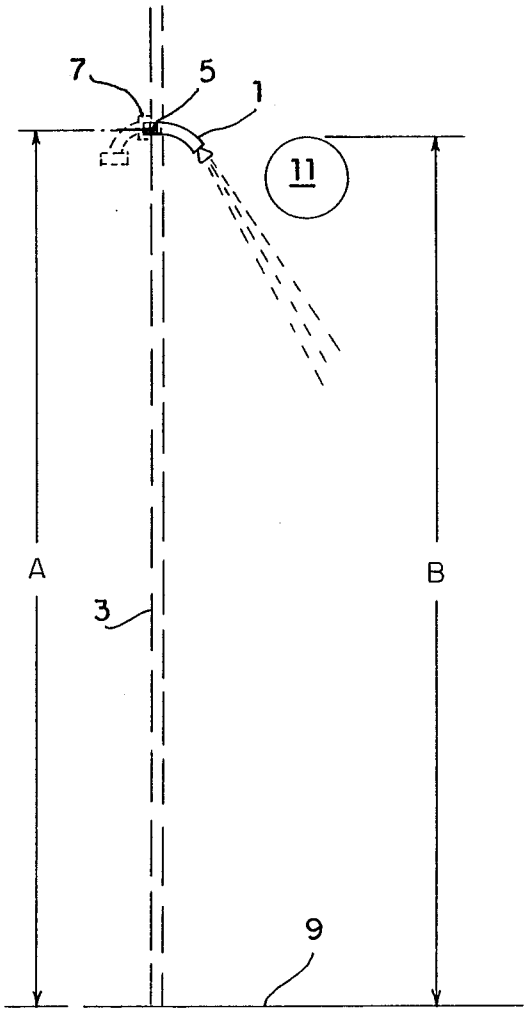
FIG. 1 shows a conventional single-head shower arm mounted with a female-threaded water supply outlet fitting in a shower-side wall.

FIG. 1 shows a conventional single-head shower arm 1 disposed through a shower-side wall 3 with its male-threaded end 5 fixedly engaged with a conventional female-threaded water supply outlet fitting 7 installed 5'-9" (indicated by dimension (A) above the floor 9, as discussed under "2. Background". The circle 11 represents the head of a male bather of 5'-8" (indicated by dimension (B) average height and standing erect while taking a shower. It can be seen that, for the bather 11 to be sprayed with shower water covering his head, shoulders and back, such bather 11 will have to duck his head and circle his body, or squat and circle his body.

Figure 3:
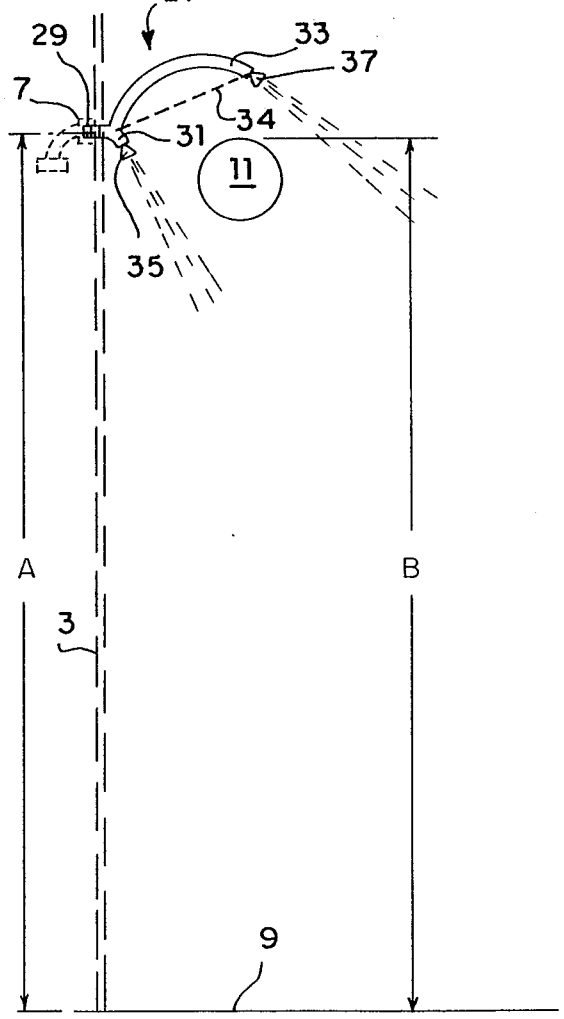
FIG. 3 shows the second embodiment of the invention of a two-head shower arm mounted with such female-threaded water supply out-let fitting.
Figure 2:
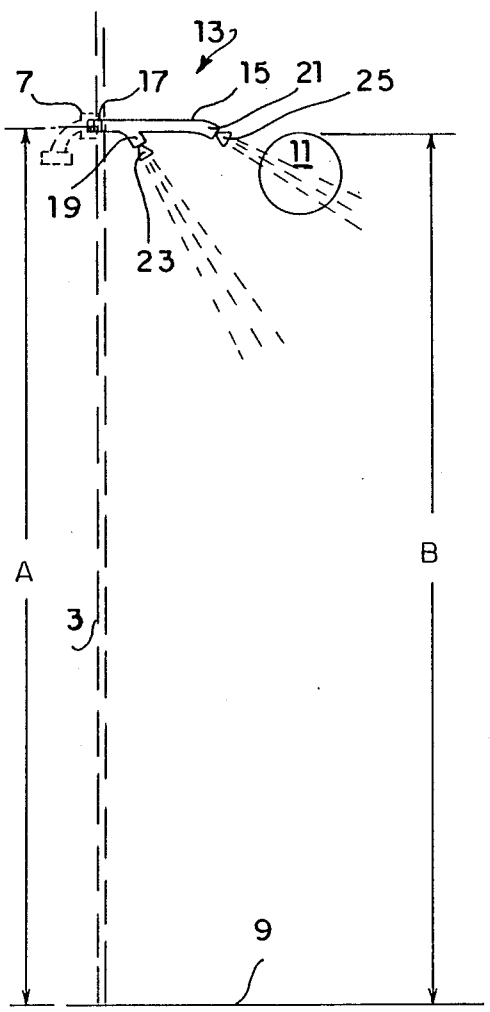
FIG. 2 shows the first embodiment of the invention of a two-head shower arm mounted with such female-threaded water supply out-let fitting.

Fig 2 shows the rigid, two-head shower arm 13 of integral, onepiece construction. Shower arm 13 has a rectilinear, straight pipe 15 whose male-threaded upstream end 17 is in fixedly threaded engagement with the female-threaded water supply outlet fitting 7 to position and dispose the shower arm 13 laterally from the shower-side wall 3. Shower arm 13 has an upstream pipe portion 19 immediately adjacent the upstream end 17. Shower arm 13 continues to and terminates in a downstream pipe portion 21 which is remote from upstream end 17. The ends of the upstream and downstream pipe portions 19 and 21 are adapted to mount conventional shower heads 23 and 25. The end of the downstream pipe portion 21 is vertically above the end of the upstream pipe portion 19 in order that water discharge from the downstream pipe portion 21 will be vertically above the water discharge from the upstream pipe portion 19 so that the head 11 of the bather, standing erect, as well as his shoulders and back, will be covered from spraying shower water discharge from the downstream pipe portion 21 and so that the rest of his body will be covered from spraying shower water discharge from the upstream pipe portion 19. The upstream and downstream pipe portions 19 and 21 depend from the rectilinear, straight pipe 15 and define thereby different obtuse angles. The obtuse angle which the downstream pipe portion 21 defines with the rectilinear, straight pipe 15 is greater than the obtuse angle which the upstream pipe portion 19 defines with the rectilinear, straight pipe 15. FIG. 3 shows the rigid, two-head shower arm 27 of integral, onepiece construction. Shower arm 27 has a male-threaded upstream end 29 in fixedly threaded engagement with the female-threaded water supply outlet fitting 7 to position and dispose the shower arm laterally from the shower-side wall 3.

Shower arm 27 has an upstream pipe portion 31 immediately adjacent the upstream end 29. Shower arm 27 curves upwardly and then donwardly to define the downstream pipe portion 33 with its continuously curved arcuate relationship that is subtended by an imaginary chord 34. The ends of the upstream and downstream pipe portions 31 and 33 are adapted to mount conventional shower heads 35 and 37. The end of the downstream pipe portion 33 is spatially located vertically well above the end of the upstream pipe portion 31 in order that water discharge from the downstream pipe portion 33 will be vertically above the water discharge from the upstream pipe portion 31 so that the head 11 of the bather, standing erect, as well as his shoulders and back, will be covered from spraying shower water discharge from the downstream pipe portion 33 and so that the rest of the bather's body will be covered from spraying shower water discharge from the upstream pipe portion 31.

I claim:

1. A rigid, two-head shower arm for use in correcting the problem of a female-threaded water supply outlet fitting incorrectly installed in a shower-side wall at an insufficient vertical distance above the floor of a shower unit such that a male bather of average height has to duck his head or squat when showering in order for shower water discharging from a conventional single-head shower arm to spray his head, shoulders and back; said rigid, two-head shower arm being of integral, one-piece construction, said two-head shower arm having a rectilinear, straight-pipe portion defining an upstream end portion, said upstream end portion having a male-threaded and adapted for fixedly threaded and anchoring engagement, in freestanding, cantilever-mounting relationship, with said female-threaded water supply outlet fitting, to dispose and protect said two-head shower arm laterally away from said shower-side wall and dispose said upstream end portion in a horizontal plane having a base line coaxial with said upstream end portion, said two-head shower arm having an upstream pipe portion and a downstream pipe portion, both said upstream pipe portion and said downstream pipe portion being oriented and disposed in an angular direction away from said shower-side wall, said upstream end portion, as anchored to said water supply outlet fitting, defining an imaginary vertical plane normal to said shower-side wall and intersecting said water supply outlet fitting, said upstream pipe portion and said downstream pipe portion being coplanar with and occupying said imaginary vertical plane, said upstream pipe portion being immediately adjacent said upstream end portion, said two-head shower arm continuing to and terminating in said downstream pipe portion, said upstream pipe portion defining trignometrically with said base line, from the aspect of counter-clockwise rotation, a positive obtuse angle said downstream pipe portion defining trignometrically with said base line, from the aspect of counterclockwise rotation, a positive angle of greater amplitude than said positive obtuse angle defined by said upstream pipe portion, said upstream pipe portion and said downstream pipe portion having terminal ends spraying shower water, said terminal end of said downstream pipe portion, spatially, being vertically above said terminal end of said upstream pipe portion, said terminal end of said downstream pipe portion spraying shower water to cover the head, shoulders and back of the male bather of average height without said bather having to duck his head or squat.

2. A two-head shower arm in accordance with claim 1, wherein said positive angle defined by said downstream pipe portion with said base line is a positive reflex angle.

3. A rigid, two-head shower arm for use in a correcting the problem of a female-threaded water supply outlet fitting incorrectly installed in a shower-side wall at an insufficient vertical distance above the floor of a shower unit such that a male bather of average height has to duck his head or squat when showering in order for shower water discharging from a conventional single-head shower arm to spray his head, shoulders and back; said rigid, two-head shower arm being of integral, one-piece construction, said two-head shower arm having a rectilinear, straight-pipe portion defining an upstream end portion, said upstream end portion having a male-threaded end adapted for fixedly threaded and anchoring engagement, in free-standing, cantilever-mounting relationship, with said female-threaded water supply outlet fitting, to dispose and project said two-head shower arm laterally away from said shower-side wall and dispose said upstream end portion in a horizontal plane having a base line coaxial with said upstream end portion, said two-head shower arm having an upstream pipe portion and a downstream pipe portion, both said upstream pipe portion and said downstream pipe portion being oriented and disposed in an angular direction away from said shower-side wall, said upstream end portion, as anchored to said water supply outlet fitting, defining an imaginary vertical plane normal to said shower-side wall and intersecting said water supply outlet fitting, said upstream pipe portion and said downstream pipe portion being coplanar with and occupying said imaginary vertical plane, said upstream pipe portion being immediately adjacent said upstream end portion, said two-head shower arm continuing to and terminating in said downstream pipe portion, said upstream pipe portion defining trignometrically with said base line from the aspect of counterclockwise rotation, a positive obtuse angle, said downstream pipe portion curving upwardly and then downwardly in continuous arcuate relationship and being subtended by an imaginary chord, said imaginary chord defining trignometrically with said base line, from the aspect of counterclockwise rotation, a positive angle of greater amplitude than said positive obtuse angle defined by said upstream pipe portion, said upstream pipe portion and said downstream pipe portion having terminal ends spraying shower water, said terminal end of said downstream pipe portion, spatially, being vertically above said terminal end of said upstream pipe portion, said terminal end of said downstream pipe portion spraying shower water to cover the head, shoulders and back of the male bather of average height without said bather having to duck his head or squat.

* * * * *